US008745941B2

(12) United States Patent
Macdonald et al.

(10) Patent No.: US 8,745,941 B2
(45) Date of Patent: Jun. 10, 2014

(54) METHOD FOR INSTALLING WALL PANELS TO THE EXTERIOR WALL OF A BUILDING

(76) Inventors: Robert B. Macdonald, London (CA); Philip A. Macdonald, London (CA)

( * ) Notice: Subject to any disclaimer, the term of this patent is extended or adjusted under 35 U.S.C. 154(b) by 436 days.

(21) Appl. No.: 13/023,086

(22) Filed: Feb. 8, 2011

(65) Prior Publication Data

US 2012/0198788 A1 Aug. 9, 2012

(51) Int. Cl.
*E04H 1/00* (2006.01)

(52) U.S. Cl.
USPC ..... 52/235; 52/312

(58) Field of Classification Search
USPC ..... 52/235, 312, 508, 511, 713, 764
See application file for complete search history.

(56) References Cited

U.S. PATENT DOCUMENTS

| | | | |
|---|---|---|---|
| 4,344,267 | A | 8/1982 | Sukolics |
| 4,439,960 | A | 4/1984 | Jenkins |
| 4,999,960 | A | 3/1991 | Herwegh et al. |
| 5,067,293 | A | 11/1991 | Reynolds |
| 5,220,759 | A | 6/1993 | Hossli |
| 5,226,274 | A | 7/1993 | Sommerstein |
| 5,239,798 | A | 8/1993 | Saito |
| 5,263,292 | A | 11/1993 | Holland et al. |
| 5,301,484 | A | 4/1994 | Jansson |
| 5,379,561 | A | 1/1995 | Saito |
| 5,522,193 | A | 6/1996 | Sommerstein |
| 5,809,729 | A | 9/1998 | Mitchell |
| 5,893,245 | A | 4/1999 | Sekiguchi et al. |
| 6,035,598 | A | 3/2000 | Sukolics et al. |
| 6,065,259 | A | 5/2000 | Clear |
| 6,098,364 | A | 8/2000 | Liu |
| 6,427,408 | B1 | 8/2002 | Krieger |
| 6,484,465 | B2 | 11/2002 | Higgins |
| 6,745,527 | B1 | 6/2004 | Sherman et al. |
| 6,748,709 | B1 | 6/2004 | Sherman et al. |
| 7,096,629 | B1 | 8/2006 | Cox |
| D619,880 | S | 7/2010 | Macdonald et al. |

(Continued)

OTHER PUBLICATIONS

Office Action issued Apr. 5, 2011 in related U.S. Appl. No. 12/507,639.

(Continued)

*Primary Examiner* — Branon Painter
(74) *Attorney, Agent, or Firm* — Peter L. Brewer; Baker Donelson

(57) ABSTRACT

A method for installing wall panels to a wall of a building is provided. The method applies the rainscreen principle. Interlocking components are used to attach aluminum or other wall panels to an exterior wall. In one aspect, the method includes operatively connecting a plurality of attachment clips to a wall surface of the exterior building wall. The method also includes providing a first panel perimeter strip and a second panel perimeter strip. The first panel perimeter strip is fastened to a first wall panel along a first side surface of the first wall panel, while the second panel perimeter strip is fastened to a second wall panel along a first side surface of the second wall panel. The method then includes sliding the first panel perimeter strip onto a first wing member of an attachment clip, thereby connecting the first wall panel to the wall, and sliding the second panel perimeter strip onto a second opposing wing member of the attachment clip, thereby connecting the second wall panel to the wall. In this way, the first side surfaces of the first and second wall panels are adjacent. The attachment clips and the panel perimeter strips represent a wall panel attachment system that is held together non-adhesively. Of significance, the system is configured to allow wall panels to be secured to a wall in any sequence or direction.

18 Claims, 8 Drawing Sheets

(56) References Cited

U.S. PATENT DOCUMENTS

| | | | |
|---|---|---|---|
| 7,752,818 | B1 | 7/2010 | Roegge |
| 2005/0060950 | A1 | 3/2005 | Hauschildt et al. |
| 2007/0119105 | A1 | 5/2007 | Macdonald et al. |
| 2010/0186343 | A1 | 7/2010 | Macdonald et al. |
| 2010/0263314 | A1 | 10/2010 | Macdonald et al. |

OTHER PUBLICATIONS

Notification Concerning Transmittal of Copy of International Preliminary Report on Patentability.
International Preliminary Report on Patentability.
Written Opinion of the International Searching Authority.
Ashtech™ Rainscreen Cladding Systems Brochure, Apr. 2005 (retrieved on Aug. 10, 2009) www.ashlandlacy.com/ashtech/index.aspx (16 pages).
CGL Rainscreen System (retrieved on Aug. 10, 2009) www.cglsystems.co.uk/products/metal-facade-systems.htm (1 page).
Northclad rainscreen solutions manual (© 2009) (21 pages).
Northclad ACM Series Details available at http://northclad.com/products/acm/details (5 pages) (retrieved on-line on Sep. 28, 2010) (© 2010).
Petersen Aluminum web page—Composite Wall Panels www.pac-clad.com/products/wall-soffitt-systems/composite-wall panels (2 pages).
Keith Panel Systems Rainscreen Data Sheets (19 pages).
Noralco Rainscreen Composite Panel Data Sheets (38 pages).
Sobotec Ltd. SL2000 Composite Panel Data Sheets (1 page).
Office Action issued Jan. 14, 2010 in related U.S. Appl. No. 11/273,303.
Notice of Allowance issued Jan. 21, 2010 in related U.S. Appl. No. 29/350,477.
Northclad Rainscreen Solutions ACM Vertical JointDetails(Copyright 2010)(retrieved on-line on Sep. 28, 2010 fromhttp://northclad.com/files/details/acm/pdf//northclad_acm-b.pdf#view=FitH,top)(1 pg).
Reynobond ACM Wall Panels brochure(Copyright 2008)(retried on-line on Sep. 28, 2010 from http:/?www.alcoa.com/aap/north_america/catalog/pdf/brochures/Reynobond_CID.pdf) (4 pages).
Electronic correspondence between Brian Elbert of Northshore Sheet Metal and Dennis McKellar of Alcolex (4 pages).
Citadel Architectural Products, Inc. Product Data Sheet for Envelope 2000 (3 pages) from www.Citadelap.com.
Letter from Peter L. Brewer of Baker, Donelson, Bearman, Caldwell & Berkowitz, PC, dated Jan. 25, 2010.
Letter from Kevin S. Costanza of Seed Intellectual Property Law Group PLLC, dated Dec. 16, 2010.

METHOD FOR INSTALLING WALL PANELS TO THE EXTERIOR WALL OF A BUILDING

STATEMENT OF RELATED APPLICATIONS

This application claims the benefit of U.S. patent application Ser. No. 12/507,639 which was filed on Jul. 22, 2009. That application is titled "Methods for Installing Wall Panels to the Exterior Wall of a Building." That application has been published as U.S. Patent Publ. No. 2010/0186343, which is incorporated herein by reference.

The application filed in 2009 claims the benefit of U.S. patent application Ser. No. 11/273,303, which was filed on Nov. 14, 2005. That application is titled "Dry Joint Aluminum Wall Panel Attachment System," and was published as U.S. Patent Publ. No. 2007/0119105. The 2005 application is also incorporated herein in its entirety by reference.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. The Background section should be read in this light, and not necessarily as admissions of prior art.

FIELD OF THE INVENTION

The present disclosure relates to wall panel attachment systems. More particularly, the present disclosure pertains to methods of attaching wall panels to exterior wall surfaces.

DISCUSSION OF TECHNOLOGY

There are various problems with known aluminum wall panel attachment systems. Conventionally, such systems have relied upon adhesive or caulk to "seal" the aluminum panel from the elements. However, under exposure to heat and cold and moisture, the adhesive or caulk breaks down. This, in turn, compromises the stability of the system and creates an undesirable appearance. Even when such a seal is functional, there may be undesirable effects on the aluminum panels as the interior environment can trap heat which affects the panels, creating popping or "oil-canning" in response to the pressure differential. In spite of such seals, such systems can also trap moisture in the wall cavity, which results in oxidation of parts and staining or deterioration of exterior wall surfaces.

More recently, systems have been developed according to the "rainscreen principle." This means that the wall cavity is vented, resulting in a temperature and pressure equalized system with moisture drainage. However, such systems can be difficult to install, relying on many components to be milled or adapted on-site, and requiring excessive labour costs and specialty materials. A need exists for a method of installing wall panels using exterior wall panel attachment systems and which permits the ingress and egress of moisture behind the panels. Further, a need exists for a method of attaching wall panels using an attachment system in which the wall panels can be attached to a wall in any sequence or direction.

SUMMARY OF THE INVENTION

A method for installing wall panels to an exterior wall of a building is provided. Each of the wall panels has an exterior surface and at least two side surfaces bent inwardly at an angle to the exterior surface. The side surfaces define a hollow interior portion. Preferably, the exterior surfaces are substantially flat.

Each of the wall panels preferably comprises an aluminum composite (or other metal) material. In one arrangement, each of the wall panels comprises an aluminum composite material which is routed and bent generally perpendicularly to form the exterior and side surfaces.

In one aspect, the method includes fastening a bracket assembly to the exterior building wall. The bracket assembly may define two back-to-back L-angle brackets fastened to each other to form a generally Z-shaped assembly. A first end of the L-angle bracket is for attachment to the wall, and a second end is for fastening to the attachment clip. The bracket assembly may be fabricated substantially from steel.

The method also includes fastening an attachment clip to the bracket assembly by at least one fastener. The attachment clip has a central fastening surface that may be fastened to the bracket assembly. The attachment clip also has at least two opposing wing members extending outwardly from the central fastening surface in a substantially symmetrical manner. The term "symmetrical" does not mean that the wing members are identical; rather, it means that the two wing members have substantially similar dimensions and are arranged so that panels may be hung from the attachment clip on either side, and in any sequence. Each of the two wing members of the attachment clip is each adapted to engage a respective panel perimeter strip for panel hanging.

In one aspect, a bracket assembly is not used and attachment clips are not connected to a bracket assembly. Instead, a plurality of attachment clips operatively connect to the wall through additional framing or to shims that are part of a wall surface. In addition, it is understood that so-called half-clips may be used for edge panels.

The method also includes providing a plurality of elongated panel perimeter strips. Each of the panel perimeter strips has a generally C-shaped member configured to reside inside a wall panel. Each C-shaped member extends along an inside portion of a side surface. Each panel perimeter strip also has a receiving member. The receiving member is integrally attached to the C-shaped member and extends beyond the side surface of a respective wall panel. The receiving member provides a slot adapted to engage and interlock one of the opposing wing members of the attachment clip. In this way, the wall panel is connected to the attachment clip and, thereby, to the wall.

A panel perimeter strip is fastened within and along at least two of the side surfaces of the wall panels. The method then includes sliding a first panel perimeter strip onto a first wing member of an attachment clip, thereby connecting the first wall panel to the wall, and sliding a second panel perimeter strip onto a second opposing wing member of the attachment clip, thereby connecting the second wall panel to the wall. In this way, the first and second wall panels are adjacent to one another on the wall. This process may be repeated for additional wall panels.

The attachment clips and the panel perimeter strips represent a wall panel attachment system that is held together non-adhesively. Of significance, the system is configured to allow wall panels with attached panel perimeter strips along respective side walls to be secured to attachment clips in any sequence or direction.

A through-opening may be provided through the wall panels to permit fluid communication from the atmosphere into the hollow interior portion of the wall panels. This allows ingress and egress of air and moisture to provide a pressure-balanced and moisture-drained interior environment for the wall panels.

In one embodiment of the method, fastening the wall panel to the first panel perimeter strip comprises running at least one rivet through the first panel perimeter strip and through a side surface of the wall panel. The through-opening through the wall panel defines the at least one rivet such that the interior portion of the wall panel is ventilated at least partially through the rivets. Thus, the rivets contribute to the ventilation of the panel.

The method may also include sliding an infill strip into the slot of the first panel perimeter strip. The infill strip resides between the attachment clip and the through opening so as to cover the fastener of the bracket assembly. The infill strip is fabricated from a substantially rigid material comprising a metal material, a polycarbonate material, polyethylene, or combinations thereof. Preferably, an aluminum composite material is used.

The infill strip may be engaged with the slot of the first panel perimeter strip prior to installing the second wall panel. Alternatively, the infill strip may be introduced to the slots of the first and second adjacent panel perimeter strips after two adjacent wall panels have been installed. In any instance, a separate infill strip may be installed between each wall panel along adjacent side surfaces.

The method may also comprise installing a panel stiffener component. The panel stiffener component is positioned inside the hollow interior portion of the respective first and second wall panels to reinforce the exterior surfaces of the wall panels and to prevent deforming or popping of the wall panels.

Additional wall panels may be attached to the exterior wall using additional bracket assemblies, attachment clips and panel perimeter strips.

BRIEF DESCRIPTION OF THE FIGURES

So that the manner in which the above recited features of the present invention can be better understood, certain drawings are appended hereto. It is to be noted, however, that the appended drawings illustrate only selected embodiments of the inventions and are therefore not to be considered limiting of scope, for the inventions may admit to other equally effective embodiments and applications.

FIGS. 5, 6 and 7 show progressive steps in the formation of an ACM panel for use in the present method, in one embodiment.

DETAILED DESCRIPTION

A method for installing panels to an exterior wall of a building is provided. The method uses an extruded aluminum (or other metal) panel attachment system for fastening a plurality of panels to a building surface. The system's strength is enhanced by the use of an extruded perimeter frame design which, with attachment clips, carries the dead load for the various panels.

Figure 1:
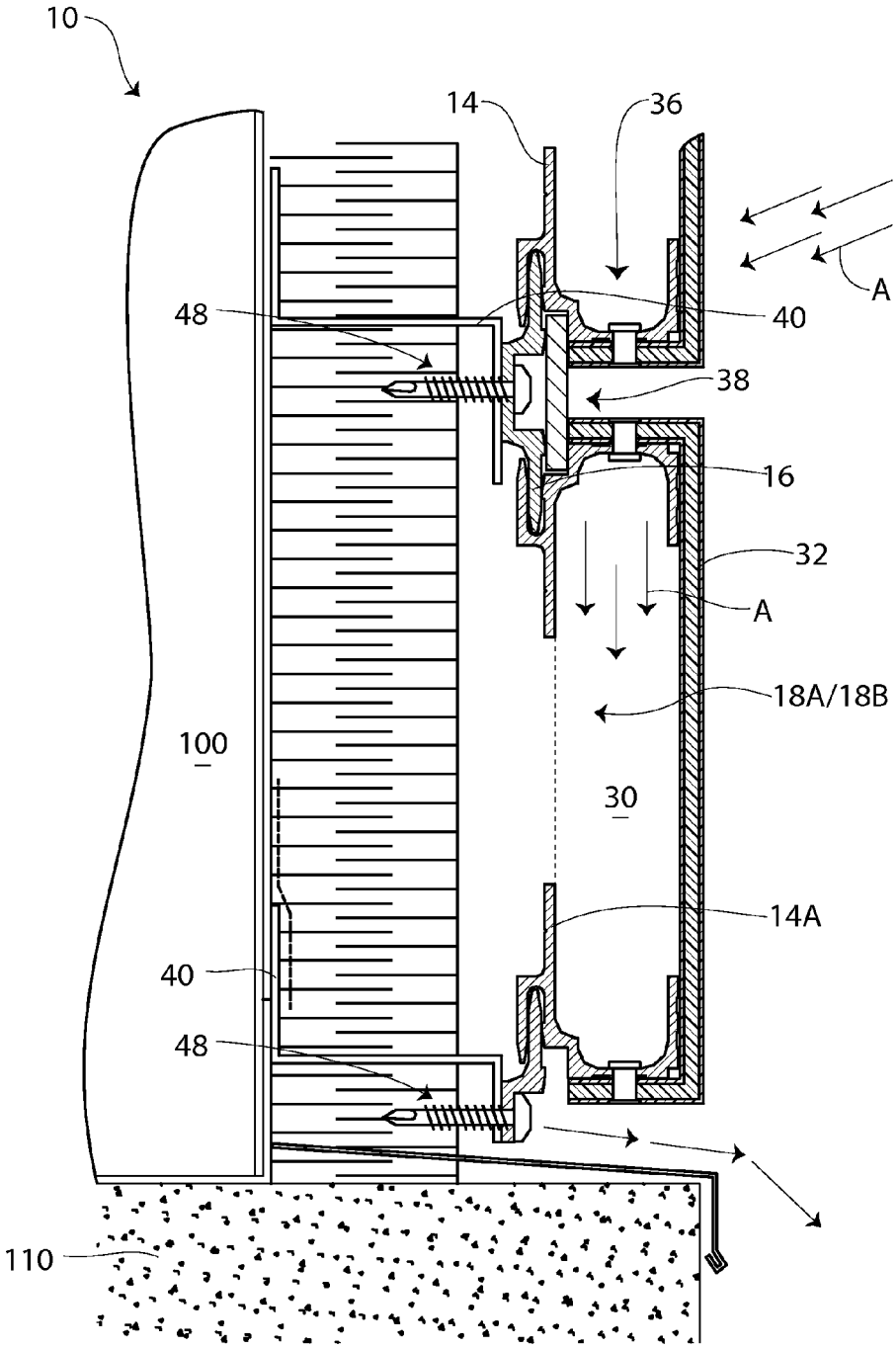
FIG. 1 shows a cross-sectional view of a dry joint aluminum wall panel attachment system as may be used in the present methods.

FIG. 1 presents a partial cross-sectional view of a dry joint wall panel attachment system 10, according to one embodiment. The system 10 is designed to be in accordance with the rainscreen principle. This means that the system 10 is designed so that a wall cavity formed under the individual panels is vented, resulting in a pressure equalized system. Controlled moisture drainage within the system, coupled with this equalized pressure, contributes to effective, maintenance free construction. The flow of air through a wall panel 32 and into a hollow interior 30 is shown at arrows "A."

The attachment system 10 may be fabricated through an extrusion process. The extrusion process begins with an aluminum billet, which is the material from which the profiles are extruded. The billet must be softened by heat prior to the extrusion process. The heated billet is placed into an extrusion press, which represents a powerful hydraulic device wherein a ram pushes a dummy block. The dummy block, in turn, forces the softened metal through a precision opening, known as a die. The die produces the required shapes.

The extruded parts are cut to specific lengths. The extruded parts may have a milled or anodized finish. It is, of course, understood that the system 10 is not limited by the specific extrusion process or other method by which the component parts may be manufactured.

Figure 2:
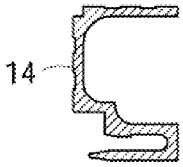
FIG. 2 is a cross-sectional view of a panel perimeter strip as may be used in the present attachment system, in one embodiment.
Figure 10:
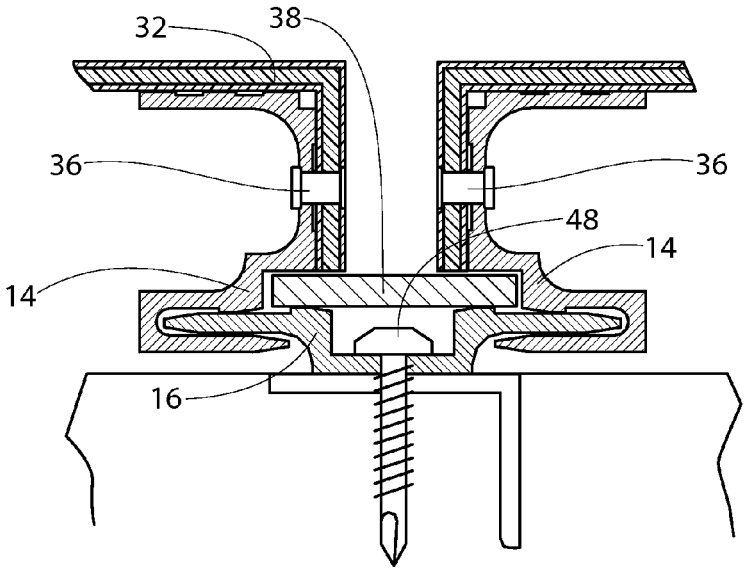
FIG. 10 shows a detailed view of the preferred placement of the infill strip in the attachment system. Two adjacent panels are seen attached to a wall.

The system 10 includes a panel perimeter strip. FIG. 2 provides a cross-sectional view of an illustrative panel perimeter strip 14. FIG. 10 provides a cross-sectional view of a pair of panel perimeter strips 14. In FIG. 10, the panel perimeter strips 14 have been connected to corners of wall panels 32. Connection is by means of counter-sunk rivets 36. FIG. 10 will be discussed in further detail below.

Referring back to FIG. 1, three panel perimeter strips are seen, with one being marked as 14A. The panel perimeter strips 14/14A are attached to at least two and preferably four side surfaces of wall panels 32. More specifically, the panel perimeter strips 14/14A reside within the hollow portion of the wall panels 32 along inside surfaces. The wall panels 32 are preferably fabricated from an aluminum composite material, or ACM. Rivets (not numbered) are also shown in FIG. 1, connecting the panel perimeter strips to the panels 32.

It is noted that the panel perimeter strips 14/14A may each be a single strip that extends substantially along the length of a side surface. Alternatively, each panel perimeter strip 14/14A may comprise one or more smaller lengths or segments. They only criterion is that the wall panel 32 be adequately supported once all panel perimeter strips 14/14A are installed.

Figure 3:
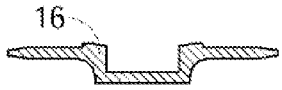
FIG. 3 is a cross-sectional view of an attachment clip as may be used in the attachment system, in one embodiment.

The system 10 also includes an attachment clip. FIG. 3 provides a cross-sectional view of an illustrative attachment clip 16. The attachment clip 16 has a central fastening surface, and a pair of integrally formed wing members. Each wing member extends outwardly from the central fastening surface in a substantially symmetrical manner. The term "symmetrical" does not mean that the wing members are identical; rather, it means that the two wing members have substantially similar dimensions and are arranged so that panels may be hung from the attachment clip on either side, and in any sequence.

FIG. 10 provides another cross-sectional view of an attachment clip 16. In FIG. 10, each wing member of the attachment clip 16 is received by an opposing panel perimeter strip 14. Thus, the panel perimeter strips 14 are designed to fit together with the wing members of the attachment clips 16. The custom-designed extrusion allows for maximum attachment area without foregoing structural integrity.

The attachment clip 16 is used on-site to attach the panel perimeter strips 14 to a building. An exterior building surface is shown in FIG. 1 at 100. The exterior building surface 100 is above a building foundation or ground surface 110.

Figure 12:
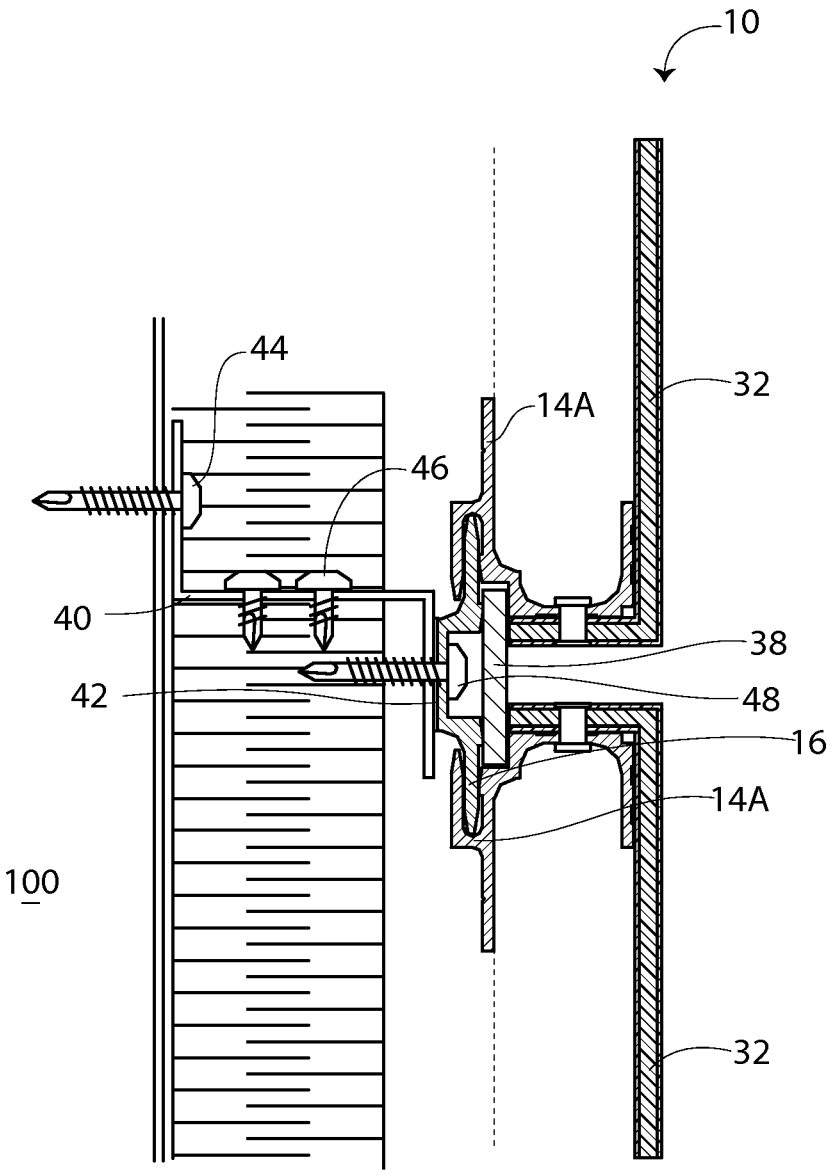
FIG. 12 shows a detailed view of the attachment system, in one embodiment, with sub-framing.

To install the panel system 10, sub-framing may be constructed. Preferably, the sub-framing comprises two back-to-back galvanized steel "L" angles. FIG. 12 is an enlarged cross-sectional view showing the system 10 of FIG. 1. In FIG. 12, two "L" angles are seen at 40. The L-angles 40 allow the installer to level the substrate in all three axes before installation of panels 32. Preferably, stainless steel screws 44 are used to connect the L-angles 40 to the building surface 100. Further, the L-angles 40 themselves may be connected through stainless steel screws 46.

Figure 11:
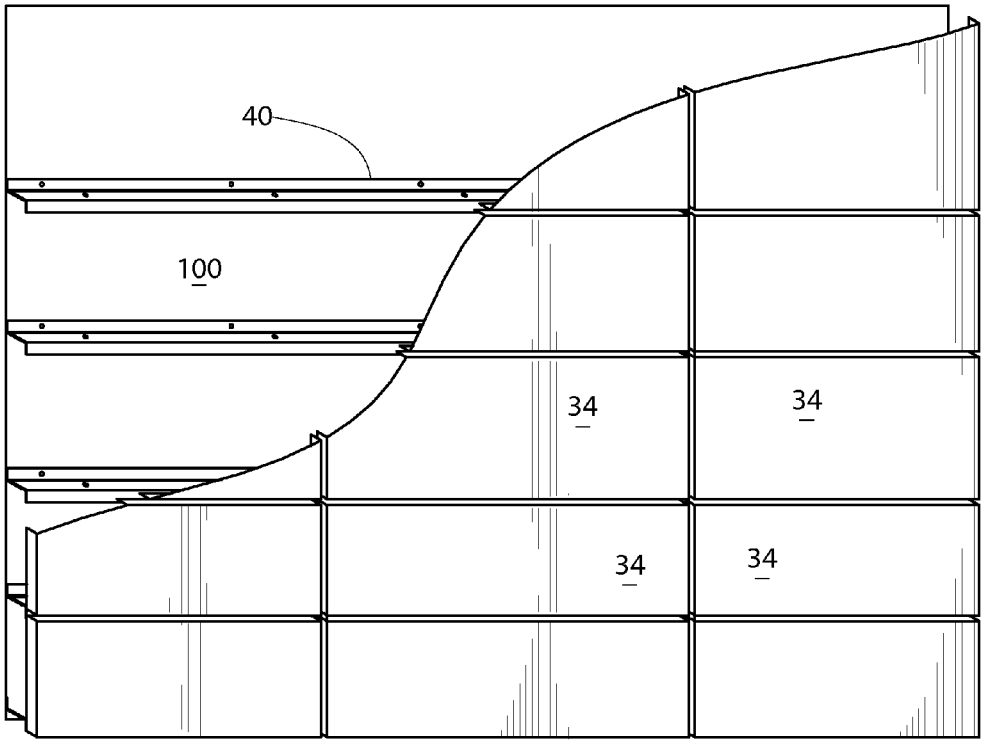
FIG. 11 shows an elevational cut-away view of the sub-framing used for mounting the ACM panels in the present attachment system, in one embodiment.

The sub-framing is typically installed horizontally at each horizontal joint. FIG. 11 shows a cut-away elevational view of the sub-framing, or L-angles 40, as installed on an exterior building surface 100. It can be seen that a series of finished ACM panel assemblies 34 have been mounted onto the exterior building surface 100. Preferably, panel assemblies 34 are mounted from the bottom of the exterior building surface 100, and moves up. In this way, the installer may make sure that each row is level relative to the previous row installed. However, it is observed here that the finished panel assemblies 34 may be installed in any sequence or direction.

This aspect of the inventions deserves further discussion. As can be seen in FIG. 11, the L-angle brackets 40 have been placed along the exterior building surface 100 in horizontal rows. The finished panel assemblies 34 may be secured to the brackets 40 from left-to-right, from right-to-left, or even out of order provided the correct spacing is maintained. Similarly, the L-angle brackets 40 may be placed along the exterior building surface 100 in vertical rows. The finished panel assemblies 34 may then be secured to the brackets 40 from bottom-to-top, from top-to-bottom, or out of order provided the correct spacing is maintained.

Referring back to FIG. 12, a layer of isolation tape 42 may be applied to the back of the aluminum attachment clips 16. This prevents direct contact between the galvanized steel sub-framing (L-angles 40) and the corresponding aluminum attachment clip 14. Thus, in turn, prevents galvanic action (electrolytic decay of the aluminum) over time. Preferably, stainless steel self-drilling screws 48 are used to fasten the aluminum attachment clips 16 to steel sub framing 40. After determining a logical order of installation, each panel 32 is be plumbed and leveled to ensure a tight and concise fit from panel to panel.

Figure 4:
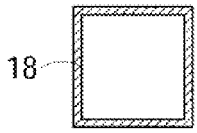
FIG. 4 shows a cross-sectional view of a panel stiffener optionally used in the attachment system.

The individual panels 32 may optionally be supported by a panel stiffener. FIG. 4 provides a cross-sectional view of a panel stiffener 18, in one embodiment. In this embodiment, the panel stiffener 18 comprises a hollow tube.

Such a panel stiffener 18 is desirable on large-sized panels. The panel stiffeners 18 may be used to prevent the popping or "oil canning" of the finished panel assemblies 34. As the individual panels 32 heat up, the panels 32 may expand and make a popping sound. The stiffeners 18 reinforce the panels 32 to reduce this effect.

Figure 18:
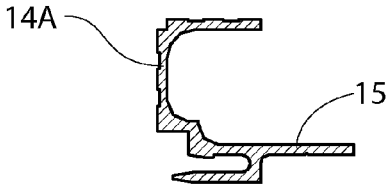
FIG. 18 shows a cross-sectional view of an alternative panel perimeter strip.
Figure 19:
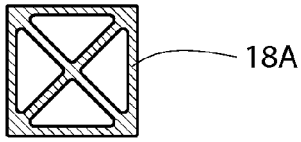
FIGS. 19 and 20 show cross-sectional views of two versions of an alternative panel stiffener.
Figure 20:
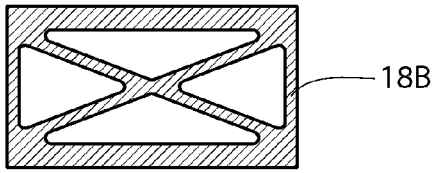

FIGS. 19 and 20 provide cross-sectional views of panel stiffeners 18A, 18B, in respective alternate embodiments. In these arrangements, the panel stiffeners 18A, 18B are internally reinforced. This provides greater stability between the exterior building surface 100 and the panel assemblies 34.

Where panel stiffeners 18, 18A, 18B are used, the panel perimeter strip 14 may be adapted to better locate and secure the stiffener component. A panel perimeter strip 14A having a profile as shown in FIG. 18 may be advantageous for this purpose. An extended interior lip 15 of the panel perimeter strip 14A operates to secure the panel stiffener component.

Panel stiffeners may be provided in different sizes depending on the wind pressures to which the panels 34 will be exposed. A larger width panel stiffener 18B may be advantageous where there are greater wind loads on the attachment system 10 or if less deflection on the individual panels 34 is desired. It will be appreciated that the construction of the panels 32 themselves also provides a basic level of rigidity, and stiffeners are not necessarily required.

Figure 9:
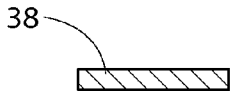
FIG. 9 shows a cross-sectional view of an infill strip as may be used in the attachment system.

The attachment system 10 also includes an infill strip. An infill strip is shown in the cross-sectional views of FIGS. 1, 10, and 12 at 38. An infill strip 38 is also shown in cross-sectional isolation in FIG. 9. The infill strip is preferably cut to a width of approximately 1¼" (32 mm) for a ½" (13 mm) joint. The infill strip 38 replaces the conventional caulk joint, giving the panel system a clean, maintenance free appearance. The infill strip 38 also is used to hide the fasteners 48 for the attachment clip 16.

Each attachment clips 16 is designed so as to interlock with a pair of panel perimeter strips 14 while holding an infill strip 38 securely in place.

Figure 5:
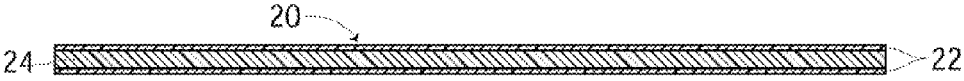
FIG. 5 shows a cross-sectional view of the aluminum composite material (ACM) as may be used in the panels in the present methods.
Figure 6:
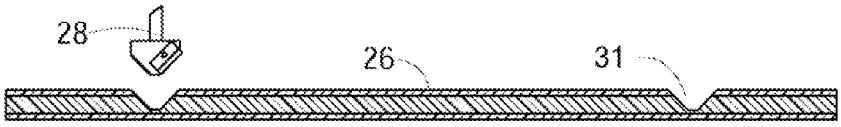
Figure 7:
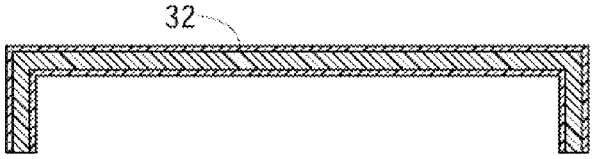

Both the infill strips 38 and the panels 32 are preferably fabricated from an aluminum composite material ("ACM"). FIGS. 5 through 7 present illustrative cross-sectional views of a panel 32 undergoing fabrication. The panel 32 is fabricated from several layers for form an ACM 20.

As shown in FIG. 5, the ACM 20 consists of a core of low density polyethylene 24 sandwiched between two sheets of aluminum 22 (each approximately 0.5 mm thick). The finish face of the aluminum sheets 22 is coated with a polyvinylidene fluoride coating. The inner aluminum layer is typically coated with chrome or polyester coatings. The standard thickness of the panel 32 is 5/32" (4 mm) but thickness may range from ⅛" (3 mm) to ¼" (6 mm), depending on customer preference or structural requirements.

A finished ACM panel 32 may be fabricated from a flat sheet of ACM 26 using different types of router and cutting bits 28 (seen in FIG. 6). After the sheet of ACM 26 has been cut and routed, the sheet 26 is then bent along the router lines 31 to form the finished panel 32 (seen in FIG. 7). The newlyshaped panel 32 is then assembled with the panel perimeter strip 14 using a panel rivet 36 to complete the finished panel assembly. A standard panel rivet for this application may be 3/16" diameter.

Figure 8:
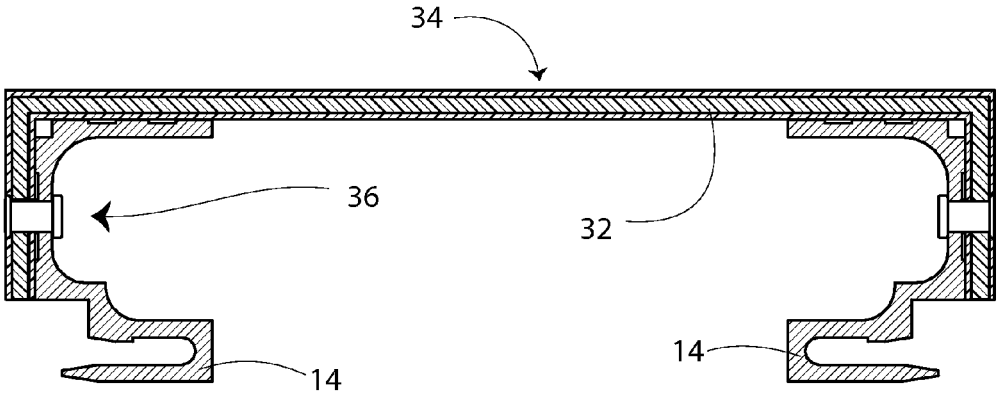
FIG. 8 shows a finished panel assembly connected to panel perimeter strips.

FIG. 8 shows a finished panel assembly 34. Panel perimeter strips 14 are shown supporting a panel 32.

There are various methods to accomplish the routing and cutting process:

Method 1

Handheld router (not shown): A handheld router is used more often when reworking a panel to a different size. This method requires the simplest tool set up, but is the most labor-intensive method of fabrication due to the lengthy time for setup and layout of each different panel.

Method 2

Vertical table saw (not shown): A vertical table saw can also be used, both to cut and rout the panels. Custom "V" routing blades can be purchased to rout the panels. Panel design is limited using the vertical table saw in itself. Using it in combination with the hand held router has its advantages, but it is still a costly way to manufacture panels.

Method 3

CNC-Machine (not shown): The computer numerically controlled (CNC) machine is a complete and concise way to manufacture panels. Once the panel has been designed by a CAD operator it is then sent directly to the machine. This machine has been found to be very useful and economical for manufacturing panels. This is the applicants' preferred method for cutting and routing panels.

FIGS. 13 through 16 demonstrate the installation of an infill strip 38 into an attachment system 10. The infill strips 38 are preferably shipped to a construction site in long lengths, and are cut to fit on-site. The strips 38 may have a protective plastic coating, which is then removed from the face of the infill strips 38 before installation.

Figure 13:
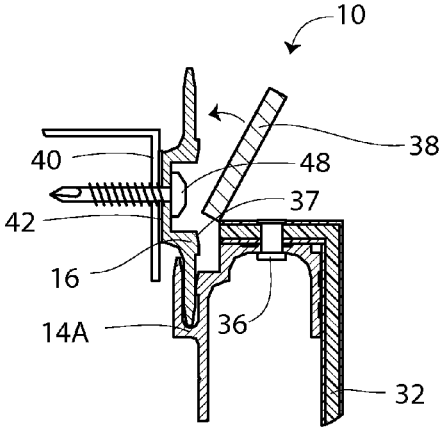
FIGS. 13, 14 and 15 show progressive steps in the installation of infill strips in the present system, according to a first method.
Figure 14:
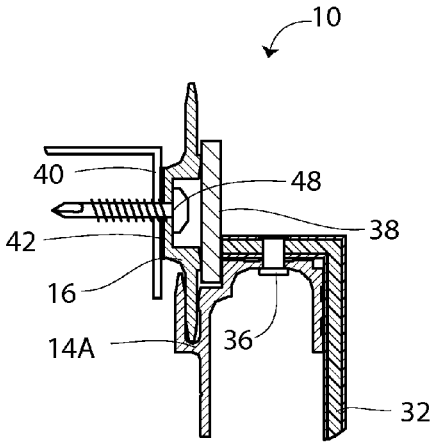
Figure 15:
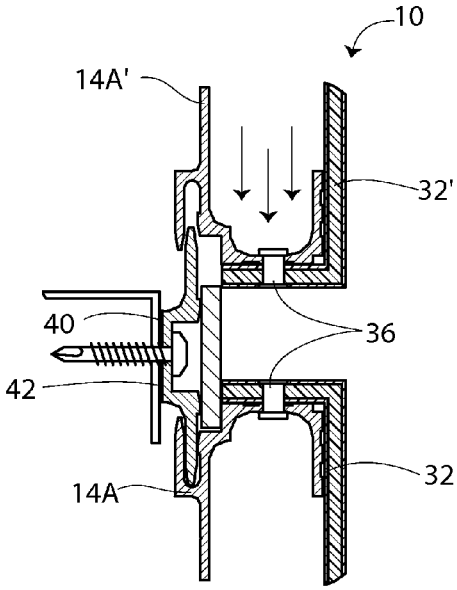

The infill strips 38 may be installed one of two ways:

First, as shown in FIGS. 13 through 15, individual infill strips 38 may be slipped into a slot 37 before the adjacent panel is installed. This is of benefit when the edge of the joint is not accessible, or when the infill strip 38 has a curve or bend in it. The infill strip 38 is fitted into the space between the panel 32 and the attachment clips 14 as illustrated in FIG. 13 and FIG. 14. Then, an adjacent panel 32' is installed so that the infill strip 38 and attachment clip 16 engage into the slots 37 in the panel edge at the perimeter strip 14A' (FIG. 15).

Figure 16:
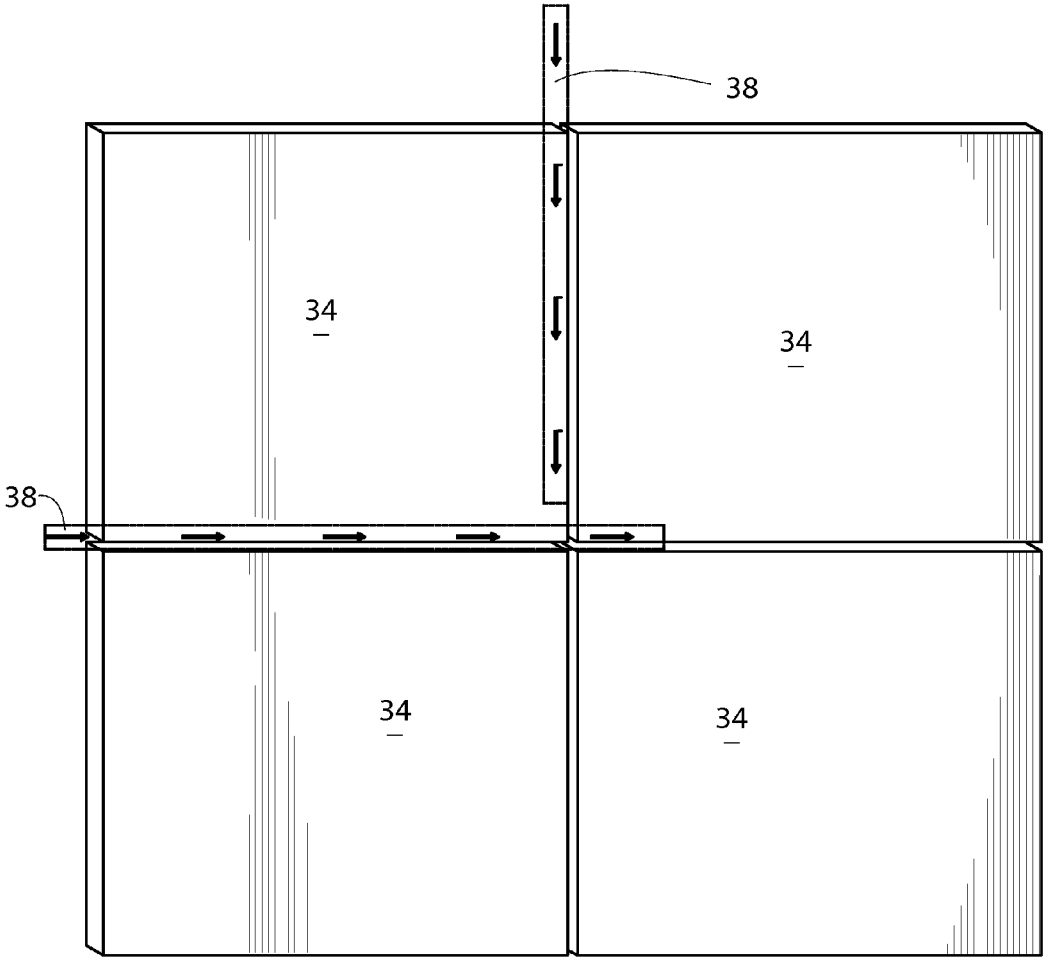
FIG. 16 shows a view of the installation of lengths of infill strip in the present system, according to a second method.

Second, and as an alternative method of installation, the installer can slide the infill strip 38 in from the end. This is shown in FIG. 16. This allows for a simplified installation of the finished panels 34. The infill strips 38 are not installed until an area is complete. This means that panel assemblies 34 can be adjusted for straightness and position even after adjacent panels have been installed. The difficulty with this method is that the end of the joint will not always be accessible (i.e. wall or window frame) and the infill strip 38 may have a tendency to catch on the attachment clips 16 as it is being slid into the joint. To aid in the sliding of the strips 38, a tool may be used to pull the leading edge of the strips 38 over the clips (not shown in FIG. 16).

Figure 17:
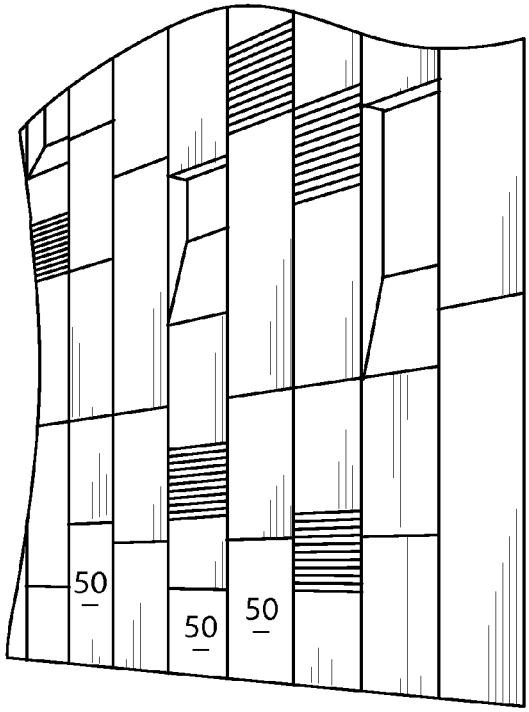
FIG. 17 shows an elevational view of a finished wall paneled exterior.

FIG. 17 presents a perspective view of a finished wall panel exterior. The finish faces of the panels 32 may have a protective film 50 to protect against minor abrasions that may occur during handling and installation. The protective film 50 may be peeled back from the returns of the panels 32 before installing. To keep the panels 32 clean and free of construction debris, generally the protective plastic film 50 is only removed from the faces of the panels once the landscaping has been completed.

As demonstrated herein, a dry joint aluminum wall panel attachment system 10 for attaching wall panels to an exterior building wall is provided. The attachment system includes a plurality of individual wall panels 32. Each wall panel has an exterior flat surface and four side surfaces. At least two of the side surfaces are bent generally perpendicularly to the exterior flat surface. In this way, a hollow interior portion 30 is defined.

The attachment system 10 also includes a plurality of bracket assemblies. Each bracket assembly is configured to be fastened to the exterior wall 100. In one aspect, each bracket assembly comprises two back-to-back L-angle brackets 40 fastened to each other via connectors 46 to form a generally Z shaped assembly. A first end is for attachment to the exterior wall surface 100, and a second end is for fastening to an attachment clip 16. Preferably, the bracket assemblies are fabricated from steel for strength.

The attachment system 10 also has a plurality of attachment clips 16. Each clip 16 is preferably fabricated from aluminum or an aluminum composite material ("ACM"), and is configured to be fastened to a respective bracket assembly by a fastener 48. Preferably, each fastener 48 comprises a threaded fastener. The attachment clips 16 carry the dead load of the wall panels 32.

Each attachment clip 16 has a pair of integrally formed wing members. Each wing member extends outwardly from the central fastening surface in a substantially symmetrical manner. Preferably, isolation tape 42 is applied between the attachment clips 16 and the respective bracket assemblies.

The attachment system 10 also includes a plurality of panel perimeter strips 14. Preferably, each panel perimeter strip 14 is fabricated from aluminum or an ACM. Each panel perimeter strip 14 is configured to be fastened to one side surface of a respective wall panel 32. Further, each panel perimeter strip 14 comprises:

- a generally C-shaped member configured to reside inside of and extend along an inside portion of a side surface of a respective wall panel 32, and
- a receiving member integrally attached to the C-shaped member configured to extend beyond the side surface of a wall panel 32 and provide a slot 37 adapted to engage and interlock one of the wing members of the attachment clip 16, thus operatively connecting a respective wall panel 32 to the attachment clip 16 and thereby to the wall 100.

The attachment system 10 may also have rivets 36. The rivets 36 are placed along the side surface of the wall panels 32 to connect the side surface of a respective wall panel 32 to a receiving member of a panel perimeter strip 14. Preferably, the rivets 36 include through-openings for providing fluid communication into the hollow inner portion 30 of the panels 32.

The attachment system 10 further includes a plurality of infill strips 38. Each infill strip 38 is preferably fabricated from a substantially rigid material comprising aluminum, polyethylene, or combinations thereof. Each of the infill strips 38 is non-sealingly disposed within respective slots 37 of adjoining panel perimeter strips 14.

The infill strips 38 are placed between a corresponding attachment clip 16 and the one or more rivets 36 so as to cover the fasteners 48. In one aspect, each infill strip 38 is engaged with the slot 37 of a panel perimeter strip prior to installing an adjacent wall panel 32. Alternatively, each infill strip 38 may be introduced to the slots 37 of two adjacent panel perimeter strips 32 after two adjacent wall panel assemblies 34 have been installed.

The attachment system 10 is held together non-adhesively. In addition, the attachment system 10 is configured to allow panel assemblies 34 to be secured to a wall in any sequence or direction.

In operation, a plurality of wall panels is provided having, for example, four side surfaces each. An elongated panel perimeter strip is attached to at least two side surfaces along inner surfaces of the side walls. Attachment is preferably by means of rivets 36.

A first set of attachment clips may be operatively connected to a wall (either directly or through bracket assemblies) along a line. A first panel assembly 34 is then connected to the attachment clips by sliding receiving members into respective wing members of the attachment clips. Additional attachment clips may then be placed along the other side surfaces of the wall panel.

As a next step, a second wall panel may be installed along the wall adjacent the first wall panel. This is done by sliding receiving members of a panel perimeter strip along a side surface of the second panel into opposing wing members of attachment clips. This step may be repeated for a third wall panel, meaning that the operator slides one of the panel perimeter strips fastened to a side surface of the third wall panel onto a wing member of one of an at least one attachment clips disposed opposite the side surface at which the second panel is located. Thus, the third wall panel is installed along the wall on a side of the first panel opposite the second panel.

A benefit of the above-described method is that wall panels may be installed relative to a first panel in a left-right sequence, a right-left sequence, an up-down sequence, or a down-up sequence. The sequences are preferably contiguous, meaning the second and third panels are adjacent to the first panel, and so forth. However, the method also permits wall panels to be hung in non-contiguous sequences, so long as the correct spacing of the attachment clips is maintained. In the case of an end panel or a panel filling a "hole," half-clips may be used.

With respect to the above example, it is also noted that the third panel may be placed adjacent to a side surface of the first panel that is not opposite the location of the second panel. Alternatively, the third panel may be placed adjacent any side surface of the second panel.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What is claimed is:

1. A method for installing wall panels to an exterior wall of a building, each of the wall panels being polygonal and having an exterior surface and at least two side surfaces bent inwardly at an angle to the respective exterior surfaces and defining a hollow interior portion, and the method comprising:

operatively connecting a plurality of attachment clips to a wall surface of the exterior building wall, wherein:

each of the attachment clips has a central fastening surface and two opposing wing members, and each wing member extends outwardly from the central fastening surface in a substantially symmetrical manner;

providing a plurality of panel perimeter strips, each panel perimeter strip comprising:

a generally C-shaped member configured to reside and to extend at least partially along an inside portion of a side surface, and a receiving member integrally attached to the C-shaped member that extends beyond the side surface of the wall panel and provides a slot adapted to interlock a wing member of an attachment clip;

fastening panel perimeter strips along at least two of the side surfaces of a first wall panel;

fastening panel perimeter strips along at least two of the side surfaces of a second wall panel;

sliding a first panel perimeter strip of the first wall panel onto a first wing member of an attachment clip, thereby connecting the first wall panel to the wall;

sliding a second panel perimeter strip of the second wall panel onto a second opposing wing member of the attachment clip, thereby connecting the second wall panel to the wall such that the first and second wall panels are adjacent;

placing an infill strip into the slot of the first and second panel perimeter strips between the attachment clip and the one or more through openings, thereby covering the central fastening surface;

wherein:

the attachment clips and the panel perimeter strips comprise a wall panel attachment system, the wall panel attachment system is held together non-adhesively, the attachment clips carry the dead loads of the wall panels, either the infill strip is engaged with the slot of the first panel perimeter strip prior to installing the second wall panel to the wall, or the infill strip is introduced to the slots of the first and second adjacent panel perimeter strips after the two adjacent wall panels have been installed to the wall; and the system is configured to allow wall panels with attached panel perimeter strips along respective side walls to be secured to attachment clips in any sequence or direction.

2. The method of claim 1, wherein the infill strip comprises a strip of aluminum composite material.

3. The method of claim 1, wherein the infill strip is fabricated from a substantially rigid material comprising a metal material, a polycarbonate material, polyethylene, or combinations thereof.

4. The method of claim 1, wherein:

each of the first and second wall panels has four sides with corresponding side surfaces; and the exterior surface of each of the panels is substantially flat.

5. The method of claim 1, wherein the first wall panel and the second wall panel each have one or more through-openings that permit fluid communication from an atmosphere into the hollow interior portion of the wall panel so as to permit ingress and egress of air and moisture to provide a pressure-balanced and moisture-drained interior environment for the wall panel.

6. The method of claim 5, further comprising:

fastening a bracket assembly to the exterior building wall; and wherein:

the step of operatively connecting the attachment clip to the first wall panel of the exterior building wall comprises fastening the attachment clip to the bracket assembly using one or more fasteners; and the infill strip covers the one or more fasteners of the bracket assembly.

7. The method of claim 6, wherein:

fastening the first panel perimeter strip to the first wall panel comprises running at least one rivet through the first panel perimeter strip and through the one side surface of the wall panel; and the through-opening through the wall panel defines the at least one rivet such that the interior portion of the wall panel is ventilated at least partially through the at least one rivet.

8. The method of claim 6, wherein the first bracket assembly comprises two back-to-back L angle brackets fastened to each other to form a generally Z-shaped assembly, a first end of which is for attachment to the wall and a second end of which is for fastening to the attachment clip.

9. The method of claim 6, wherein each of the one or more fasteners comprises a threaded fastener.

10. The method of claim 6, wherein the first panel perimeter strip is fastened to a side surface of first wall panel before being fastened to the first bracket assembly.

11. The method of claim 5, further comprising:

installing a panel stiffener component inside the hollow interior portion of the first and second wall panels to reinforce the exterior surfaces of the wall panels and preventing deforming or popping of the wall panels.

12. The method of claim 1, wherein each of the wall panels comprises an aluminum composite material.

13. The method of claim 1, wherein each of the wall panels comprises an aluminum composite material which is routed and bent generally perpendicularly to form the exterior and side surfaces.

14. The method of claim 1, further comprising:

operatively connecting at least one attachment clip to the wall surface of the exterior building wall adjacent a side surface of the first panel opposite the side surface at which the second panel is located;

fastening a third panel perimeter strip along a side surface of a third wall panel; and sliding the third panel perimeter strip fastened to a side surface of the third wall panel onto a wing member of one of the at least one attachment clips disposed opposite the side surface at which the second panel is located.

15. The method of claim 14, further comprising:

applying an isolation tape between the attachment clip and the bracket assembly.

16. The method of claim 14, wherein:

the first and second opposing wing members are vertically oriented;

each of the first, second and third panel perimeter strips is vertically oriented; and the first, second and third wall panels are in horizontal relation.

17. The method of claim 16, further comprising:

operatively connecting a horizontally-oriented attachment clip to a wall surface of the exterior building wall;

fastening a horizontal panel perimeter strip along a horizontally-oriented side surface of each of the first, second, and third wall panels;

also sliding the horizontal panel perimeter strips of the first, second and third wall panels onto a wing member of the horizontally-oriented attachment clip; and sliding a horizontally-oriented panel perimeter strip of a fourth wall panel onto an opposing wing member of the horizontally-oriented attachment clip below the first, second or third wall panel.

18. The method of claim 14, wherein:

the first and second opposing wing members are horizontally oriented;

each of the first, second and third panel perimeter strips is horizontally oriented; and the first, second and third panels are in vertical relation.

* * * * *